United States Patent [19]

Woo Seop

[11] 4,372,443

[45] Feb. 8, 1983

[54] CIGARETTE PACKAGE WHICH HAS DEVICE TO OPEN AND CLOSE

[76] Inventor: Choi Woo Seop, 567 Hapjeong-Ri, Pyongtaek-Eup, Pyongtaek-Kun, Kyonggi-Province, Rep. of Korea

[21] Appl. No.: 232,697

[22] Filed: Feb. 9, 1981

[30] Foreign Application Priority Data

Jan. 24, 1981 [KR] Rep. of Korea ..... 496/81[U]

[51] Int. Cl.[3] ..... B65D 85/10; B65D 85/12

[52] U.S. Cl. ..... 206/264; 206/268; 206/273; 229/17 R

[58] Field of Search ..... 206/268, 273, 264, 265, 206/271; 229/17 R

[56] References Cited

U.S. PATENT DOCUMENTS

| | | | |
|---|---|---|---|
| 2,339,656 | 1/1944 | Shina | 206/268 |
| 2,928,571 | 3/1960 | Caruso | 206/268 |
| 2,940,590 | 6/1960 | Hook | 206/268 |
| 2,960,264 | 11/1960 | Walter | 206/268 |
| 3,214,009 | 10/1965 | Tamarin | 206/268 |
| 3,272,321 | 9/1966 | Tamarin | 206/268 |

*Primary Examiner*—Joseph Man-Fu Moy

*Attorney, Agent, or Firm*—Fleit & Jacobson

[57] ABSTRACT

A package formed from a folded blank for containing cigarettes. The package has side surfaces, front and rear surfaces interconnecting the side surfaces, a top surface, and a bottom surface. The top surface of the package has a crease line formed therein spaced from and extending parallel to the plane of the front surface and first and second slots extending from ends of the crease line towards the rear surface. A portion of the blank forming one of the side surfaces has a first crescent-shaped part formed therein by a groove extending between an end of the first slot spaced intermediate the crease line and the rear surface and the intersection of the front, the top, and the one side surface. Another portion of the blank forms a crescent-shaped part protruding from the portion of the blank forming the top surface. The second part is separated from the top surface by the second slot and is connected to the portion of the top surface located between the crease and the front surface. Portions of the blank when folded being folded over the first and the second crescent-shaped parts to maintain the package closed. The top surface is foldable about the crease line to open the package.

1 Claim, 4 Drawing Figures

CIGARETTE PACKAGE WHICH HAS DEVICE TO OPEN AND CLOSE

a. When the package is closed.

b. When the package is opened.

Figure 4:
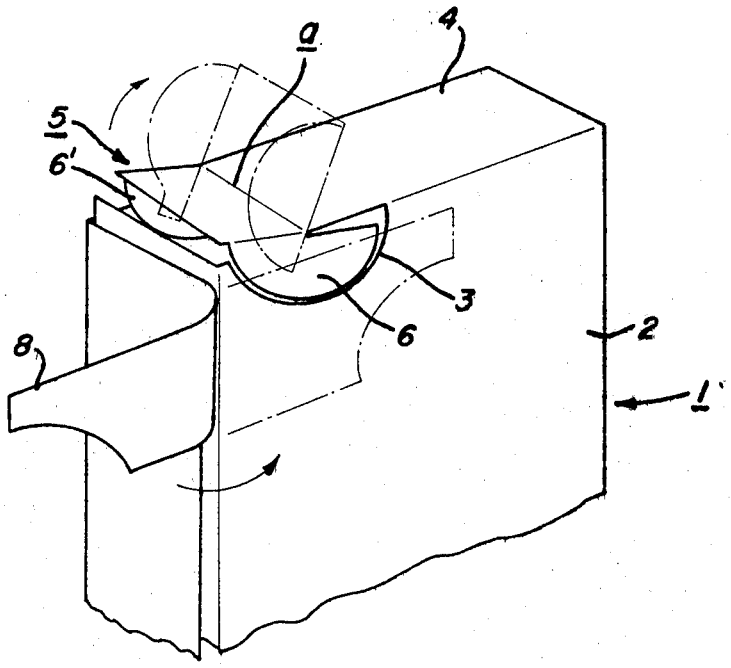

FIG. 4: Strabismal diagram showing how the important parts work.

DETAILED EXPLANATION OF THE INVENTION

Figure 1:
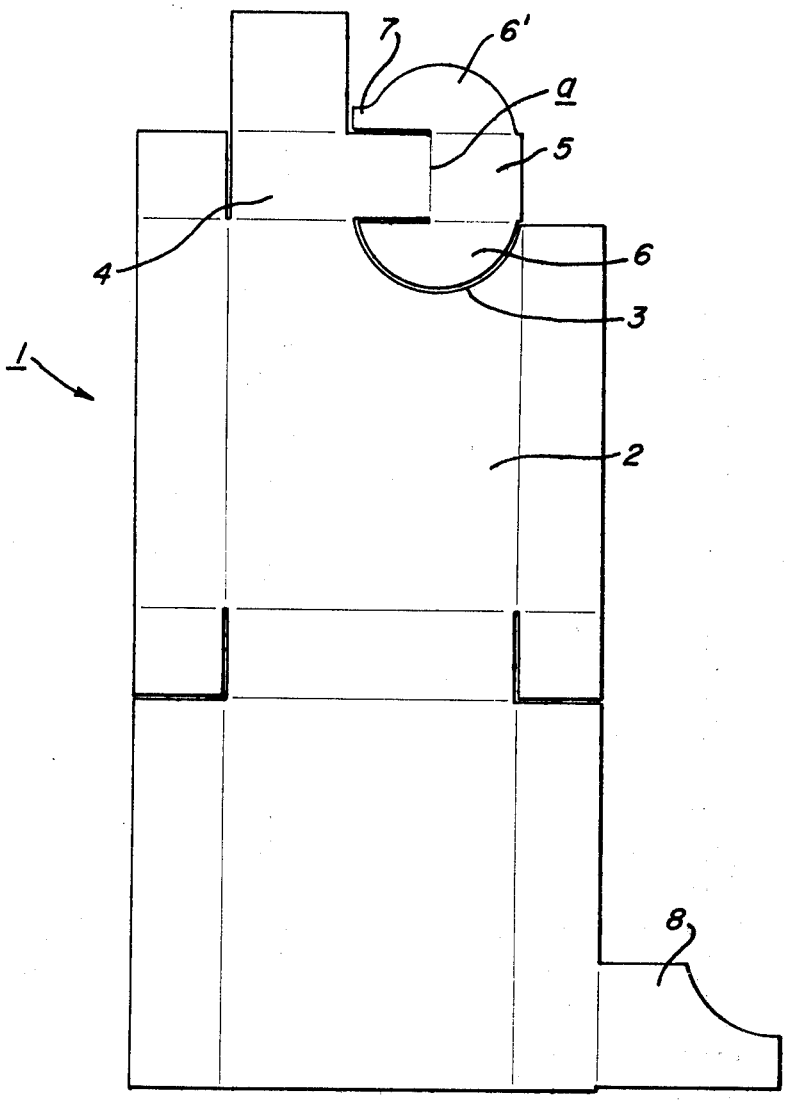
FIG. 1: Plane diagram of the manila paper package when unfolded.
Figure 2:
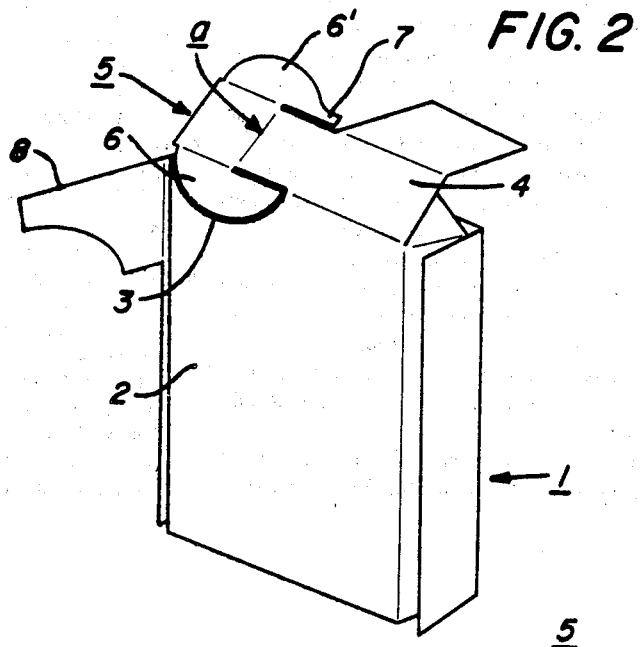
FIG. 2: Strabismal diagram of the package.
Figure 3A:
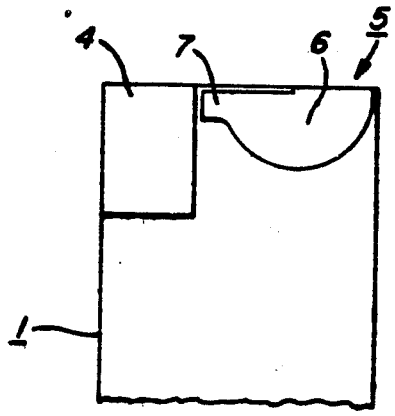
FIG. 3: Shows how the package is opened and closed by sliding back and forth.
Figure 3B:
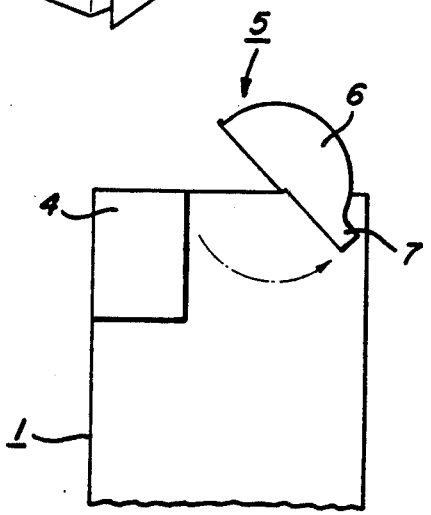

This is an invention of a new cigarette package. Manila paper is used material, cut as illustrated in FIG. 1, and then to be fabricated, this package is attached with slips on top of package body, which can be easily slided back and forth for opening and closing. With the conventional package, the top part of the package was to be cut away in optional size to pull the cigarettes out of the packages. When the cigarettes are carried in the state of the above package, there were defects in that the cigarettes are smeared with insanitary dust, or the tobacco residue were to be dropped out in the pocket.

In order to supplement the forementioned defects, smokers used separate cigarette cases to find it very inconvenient to carry because they were made of hard materials.

This defect is corrected with this new invention by installing an dichotomy-shaped working slips at the top of the package.

The working slips are equipped for sliding inward and outward to open and close the package, which is prevented from sliding over beyond the upright position. Illustrative explanation is as follows:

On one side of the top of the exterior front surface (2) of the package body (1), a dichotomy-shaped groove specified as (3) is cut and a part of the area specified as (4) is used a working slip (5) with the two dichotomy-shaped specified as (6) and (6') at both ends which fit the size of above groove (3). Of the two working slips (6) and (6'), working slip (6) rotates back and forth within the groove (3), and the other working slip (6') has a projection on an end of itself specified as (7). The part specified as (8) plays a role in preventing one of the working slip (6) from separating from the main package body. By pulling working slip (5) upward and pressing downward, the package is opened and closed with the crease (a) as starting line. By adding a projection (7) on an end of the working slip (6), the projection (7) holds the working slip (5) vertical upright against the side of package body when the working slip (5) is slided to open. By keeping the working slip (5) in vertical position, it makes it easy to slide back to close the package. In this working process, the crease (a) is kept safe from damage. The package cannot be slided open by itself. Therefore it keeps from gathering dusts and cigarette residue not allowed inside pocket. It is sanitary, inexpensive, and practical.

What is claimed is:

1. A package formed from a folded blank for containing cigarettes, the package having side surfaces, front and rear surfaces interconnecting the side surfaces, a top surface, and a bottom surface; the top surface of the package having a crease line formed therein spaced from and extending parallel to the plane of the front surface and first and second slots extending from ends of the crease line towards the rear surface; a portion of the blank forming one of the side surfaces having a first crescent-shaped part formed therein by a groove extending between an end of said first slot spaced intermediate said crease line and rear surface and the intersection of said front, said top, and said one side surface; another portion of the blank forming a second crescent-shaped part protruding from the portion of the blank forming the top surface, said second part being separated from the top surface by said second slot and being connected to the portion of the top surface located between said crease and said front surface; portions of said blank when folded being folded over said first and said second crescent-shaped parts to maintain the package closed, said top surface being foldable about the crease line to thereby open the package, wherein one of said-crescent shaped parts has a projecting portion for limiting movement of the top surface about the crease line when the package is opened.

* * * * *